US011268656B2

(12) United States Patent
Lolia et al.

(10) Patent No.: US 11,268,656 B2
(45) Date of Patent: Mar. 8, 2022

(54) CALCULATION OF REMAINING USAGE TIME OF A GAS CYLINDER

(71) Applicant: Luxembourg Patent Company S.A., Lintgen (LU)

(72) Inventors: Romain Lolia, Yutz (FR); Jean-Claude Schmitz, Heisdorf (LU)

(73) Assignee: Rotarex S.A., Lintgen (LU)

( * ) Notice: Subject to any disclaimer, the term of this patent is extended or adjusted under 35 U.S.C. 154(b) by 902 days.

(21) Appl. No.: 16/071,369

(22) PCT Filed: Jan. 20, 2017

(86) PCT No.: PCT/EP2017/051250
§ 371 (c)(1),
(2) Date: Jul. 19, 2018

(87) PCT Pub. No.: WO2017/125589
PCT Pub. Date: Jul. 27, 2017

(65) Prior Publication Data

US 2021/0172568 A1 Jun. 10, 2021

(30) Foreign Application Priority Data

Jan. 21, 2016 (LU) ..... 92953

(51) Int. Cl.
*F17C 13/02* (2006.01)

(52) U.S. Cl.
CPC ..... *F17C 13/025* (2013.01); *F17C 2205/035* (2013.01); *F17C 2205/0338* (2013.01);
(Continued)

(58) Field of Classification Search
CPC ..... F17C 13/025; F17C 2205/0338; F17C 2205/035; F17C 2223/0123;
(Continued)

(56) References Cited

U.S. PATENT DOCUMENTS 4,970,897 A 11/1990 Budinger
5,159,839 A 11/1992 Silber et al.
(Continued)

FOREIGN PATENT DOCUMENTS

DE 102007053627 B3 2/2009
EP 1145740 A1 10/2001
(Continued)

OTHER PUBLICATIONS

Naci Zafer, "Stability of gas pressure regulators"; Jan. 3, 2007, Elsevier Inc.*
(Continued)

*Primary Examiner* — Natalie Huls
*Assistant Examiner* — Sharad Timilsina
(74) *Attorney, Agent, or Firm* — Sandberg Phoenix & von Gontard P.C.

(57) ABSTRACT

A method for calculating the remaining usage time of a gas cylinder equipped with a pressure reducer, the method comprising the following steps: (a) measuring the pressure of the gas in the cylin-der; (b) calculating the variation of pressure of the gas in the cylinder over time while gas is out-putted; (c) calculating a remaining usage time Tr based on the measured pressure in the cylinder and the calculated variation of pressure. Step (c) takes into account characteristics of the pressure reducer relative to variations of its nominal flow rate along the decrease of its inlet pressure while emptying the cylinder.

17 Claims, 2 Drawing Sheets

(52) U.S. Cl.
CPC ..... *F17C 2223/0123* (2013.01); *F17C 2250/043* (2013.01); *F17C 2250/0473* (2013.01); *F17C 2260/026* (2013.01)

(58) Field of Classification Search
CPC ..... F17C 2250/043; F17C 2205/0473; F17C 2260/026
See application file for complete search history.

(56) References Cited

U.S. PATENT DOCUMENTS

| | | | | |
|---|---|---|---|---|
| 6,543,444 | B1 * | 4/2003 | Lewis | A62B 9/006 128/200.24 |
| 7,104,124 | B2 | 9/2006 | Stabile et al. | |
| 2008/0140336 | A1 * | 6/2008 | Home | G01F 23/14 702/130 |
| 2008/0150739 | A1 | 6/2008 | Gamard | |
| 2008/0251074 | A1 * | 10/2008 | Sand | F17C 13/025 128/204.18 |
| 2008/0319687 | A1 * | 12/2008 | Kurosawa | F17C 13/025 702/50 |
| 2012/0080103 | A1 * | 4/2012 | Levine | G01L 19/12 137/552.7 |

FOREIGN PATENT DOCUMENTS

| | | | |
|---|---|---|---|
| FR | 2868160 | A1 | 9/2005 |
| WO | 2014074313 | A1 | 5/2014 |
| WO | 2015036663 | A1 | 3/2015 |

OTHER PUBLICATIONS

Bill Lee, "Electronic Pressure Regulator"; Jul. 16, 1990, American Institute of Aeronautics and Astronautics.*
International Search Report for corresponding PCT/EP2017/051250 dated Apr. 4, 2017.

* cited by examiner

CALCULATION OF REMAINING USAGE TIME OF A GAS CYLINDER

CROSS-REFERENCE TO RELATED APPLICATIONS

The present invention is the US national stage under 35 U.S.C. § 371 of International Application No. PCT/EP2017/051250, which was filed on Jan. 20, 2017, and which claims the priority of application LU 92953 filed on Jan. 21, 2016, the content of which (text, drawings and claims) are incorporated here by reference in its entirety.

FIELD

The invention is directed to the field of compressed gas, like oxygen. The invention is also directed to the field of gas cylinders equipped with a pressure reducer device for outputting a flow of gas to an end user.

BACKGROUND

Prior art patent document published U.S. Pat. No. 7,104,124 B2 discloses a system for identifying the remaining usage time of a gas cylinder until the decrease of the output flow rate. The system reads the pressure and optionally the temperature of the gas in the cylinder. A flow rate is deducted from the measured pressure drop. This can be corrected by a potential detection of temperature variation beyond a given range. The remaining usage time is calculated by dividing the number of litres of gas calculated from the pressure (and optionally the temperature) by the calculated flow rate expressed in litres per minute.

Prior art patent document published FR 2 868 160 B1 discloses similarly to the previous document a system for calculating the remaining usage time of a gas cylinder until the decrease of the output flow rate. The calculation is based only on the pressure in the cylinder. That pressure is measured over time and this variation over time is calculated for deriving the remaining usage time.

In both above teachings, the gas consumption is detected solely by detecting a variation of pressure in the gas cylinder. The influence of the gas consumption cannot however always be detected by observing the pressure variation, at least over a reduced period of time. Indeed, the gas consumption is usually of a few litres per minute and has a limited impact on the cylinder pressure over a reduced period of time. The pressure in the cylinder can also be influenced by temperature variations of the gas. For example, an increase of temperature can compensate the pressure decrease due to a gas consumption. Similarly, a decrease of the gas temperature in the absence of gas consumption will lead to a pressure decrease that could be interpreted as resulting from a gas consumption.

Prior art patent document published WO 2014/074313 A1 discloses a pressure reducer device for a gas cylinder, the device being equipped with a flow selector and an electronic unit for calculating and displaying while gas is outputted the remaining usage time until the cylinder is empty (or reaches a limit lower level). The electronic unit comprises a position detector of the flow selector so as to receive an information of the flow rate that is selected. On one hand, this approach is interesting for the devices provided with means for varying the flow rate since it provides a rather accurate means for detecting the selected flow rate. On the other hand, this approach requires the use of a position detector which implies potential errors or dysfunctions and also a higher production cost. Also, the flow rate of a pressure reducer is not necessary constant over the emptying process of a gas cylinder, essentially due to the irregularity that can be intrinsic of a pressure reducer. In other words, even when knowing the position of the flow selector, the flow rate might vary during the gas consumption, thereby leading to errors in the calculated remaining usage time.

SUMMARY

The invention has for technical problem to provide a solution that overcomes at least one of the drawbacks of the above mentioned prior art. More specifically, the invention has for technical problem to provide a solution for calculating the remaining usage time of a gas cylinder equipped with a pressure reducer device, which is simple, accurate and reliable.

The invention is directed to a method for calculating the remaining usage time of a gas cylinder equipped with a pressure reducer, the method comprising the following steps: (a) measuring the pressure of the gas in the cylinder; (b) calculating the variation of pressure of the gas in the cylinder over time while gas is outputted; (c) calculating a remaining usage time $T_r$ based on the measured pressure in the cylinder and the calculated variation of pressure; wherein step (c) takes into account characteristics of the pressure reducer relative to variations of its nominal flow rate along the decrease of its inlet pressure while emptying the cylinder.

According to various embodiments, in step (c) the characteristics of the pressure reducer comprise a pressure irregularity factor $I_p$ reflecting the variation of the nominal outlet pressure of the pressure reducer along the decrease of its inlet pressure while emptying the cylinder.

According to various embodiments, the pressure irregularity factor $I_p$ is a ratio of a maximum outlet pressure difference by a nominal outlet pressure of the pressure reducer.

According to various embodiments, in step (c) the characteristics of the pressure reducer comprise a flow rate irregularity factor $I_f$ reflecting the variation of the nominal flow rate of the pressure reducer along the decrease of its inlet pressure while emptying the cylinder.

According to various embodiments, the flow rate irregularity factor $I_f$ is a ratio of a maximum flow rate difference by a nominal flow rate of the pressure reducer.

According to various embodiments, step (c) comprises the calculation of an average flow rate until emptying the cylinder based on the calculated variation of pressure over time and the characteristics of the pressure reducer.

According to various embodiments, in step (c) an average pressure decrease over time is calculated based on the calculated average flow rate.

According to various embodiments, in step (c) an average pressure decrease over time is calculated based on the calculated pressure variation and the characteristics of the pressure reducer.

According to various embodiments, in step (c) the calculation of the remaining usage time is based on the measured pressure in the cylinder and the average pressure decrease.

According to various embodiments, steps (a), (b) and (c) are executed in an iterative manner, and the laps of time between each iteration being preferably comprises between 5 and 300 seconds.

According to various embodiments, for each iteration, the calculation of step (b) is based on the variation of pressure over time calculated at the previous iteration.

According to various embodiments, step (b) is executed only when an output of gas is detected.

According to various embodiments, step (a) comprises measuring the outlet pressure of the pressure reducer, and wherein in step (b) the output of gas is detected when the measured outlet pressure is greater than a predetermined value.

According to various embodiments, the method comprises a step (d) of displaying the remaining usage time.

The invention is also directed to a control unit for a pressure reducer device to be mounted on a gas cylinder, comprising a microcontroller with instructions for calculating a remaining usage time based on the measured pressure in the cylinder and the calculated variation of pressure; wherein the instructions are configured for executing the method according to the invention.

The invention is also directed to an electronic unit for a pressure reducer device to be mounted on a gas cylinder, comprising a control unit, a display, at least one pressure sensor; wherein the control unit is according to the invention.

According to various embodiments, the unit comprises an electric power source, the source being preferably external to the control unit and/or the display.

The invention is also directed to a pressure reducer device for a gas cylinder, comprising a body; a pressure reducer in the body; a flow selector in the body; an electronic unit for calculating and displaying a remaining usage time while gas is outputted; wherein the electronic unit is according to the invention.

According to various embodiments, the device further comprises a cover housing the body and the electronic unit.

The invention is particularly interesting in that it provides a reliable and accurate information about the remaining usage time of the gas cylinder at the current settings of the device. It can also take into account the variation in the settings like the selection of flow rate. It avoids having to detect the position of the flow selector or any other movable element of the device. The construction remains therefore simple, robust and cheap. A classical single-stage pressure reducer can be used, even with some irregularity along the emptying process of the gas cylinder.

DRAWINGS

DESCRIPTION

Figure 1:
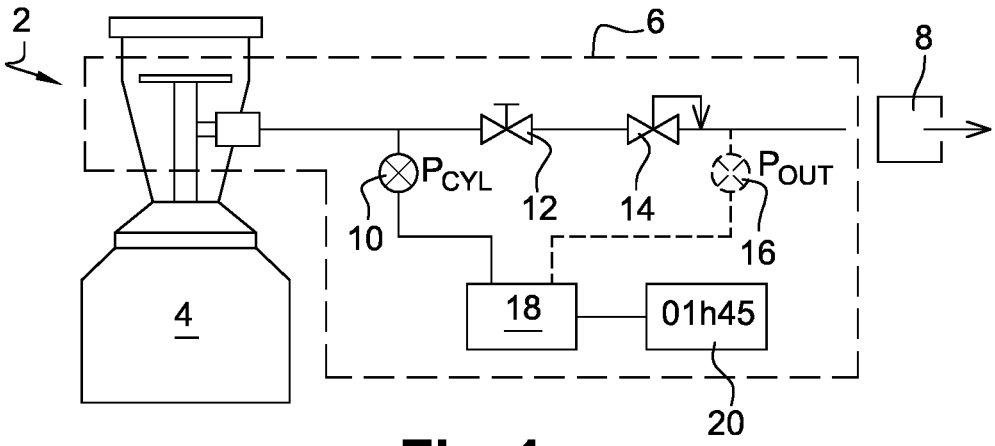
FIG. 1 is a schematic illustration of a gas cylinder equipped with pressure reducer device in accordance with various embodiments of the invention.

FIG. 1 illustrates the architecture of a gas cylinder assembly 2 comprising essentially a gas cylinder 4 and a pressure reducer device 6 in accordance with various embodiments of the invention.

A pressure reducer device in the present invention is to be understood as any device that is able to be mounted on a gas container, such as a gas cylinder or bottle, with gas under high pressure, typically above 100 bar, and able to deliver from the container a flow of gas at a reduced pressure, typically below 20 bar, to a consumer 8.

In the present embodiments, the pressure reducer device 6 comprises a pressure sensor 10 measuring the pressure $P_{cyl}$ inside the gas cylinder 4, a shut-off valve 12 for shutting-off the gas passage in the device, a pressure reducer 14 and optionally a pressure sensor 16 measuring the pressure $P_{out}$ at the outlet of the pressure reducer 16 and of the device 6. For instance, these different components are disponed in that order in the normal gas flow direction when gas is delivered to a user or consumer 8.

For instance, the gas can be oxygen and the user can be an end-user such as a patient needing a supply of oxygen for breathing.

The pressure reducer device 6 comprises also an electronic unit 18 with a microcontroller receiving a signal from the cylinder pressure sensor 10 and optionally a signal from the outlet pressure sensor 16. The electronic unit 18 is configured for executing an algorithm that calculates, among others, the remaining usage time of the assembly 2 when this latter is outputting a flow of gas to the user 8. This algorithm will be detailed below, in particular in relation with FIG. 5. A signal of the calculated remaining usage time is outputted by the electronic unit 18 and received by the display 20. This latter has been illustrated as an item distinct from the electronic unit, being however understood that both can be integrated in a single item or unit.

Figure 2:
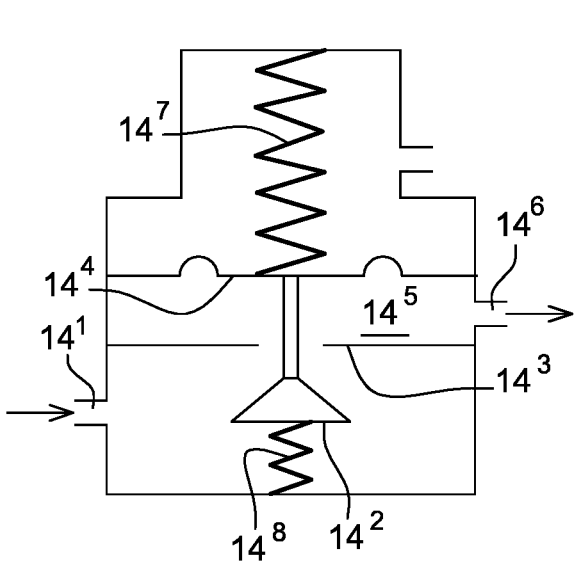
FIG. 2 is a schematic sectional view of a pressure reducer, as in the device of FIG. 1, in accordance with various embodiments of the invention.
Figure 3:
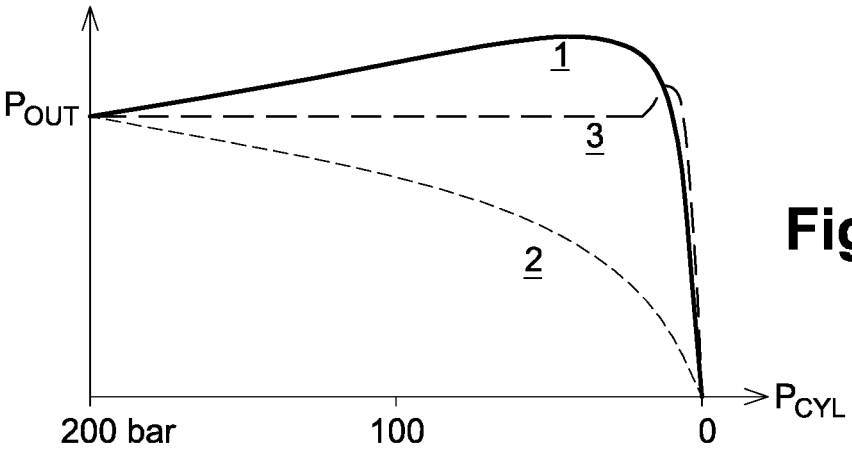
FIG. 3 is a graphical representation of the outlet pressure of different types of pressure reducer relative to the inlet pressure when the pressure decreases from 200 bar to about 0 bar, in accordance with various embodiments of the invention.
Figure 4:
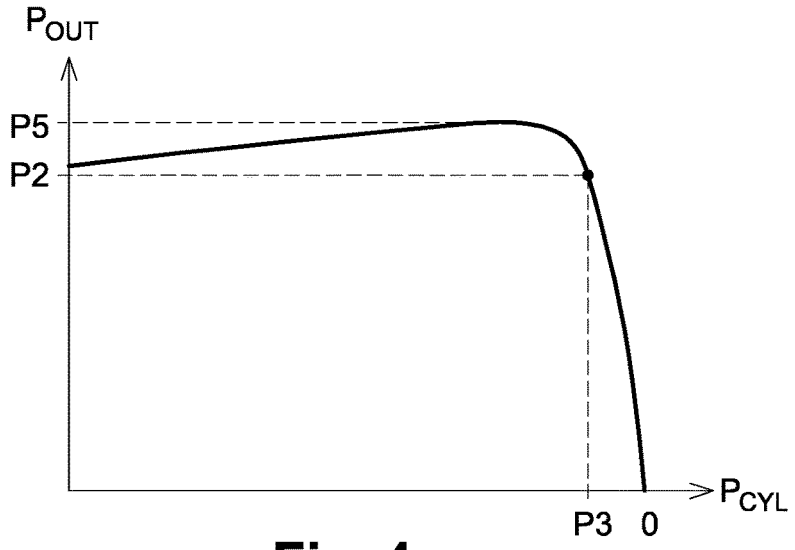
FIG. 4 is a graphical representation of the outlet pressure of a pressure reducer, as in FIG. 2, relative to the inlet pressure when the pressure decreases, in accordance with various embodiments of the invention.
Figure 5:
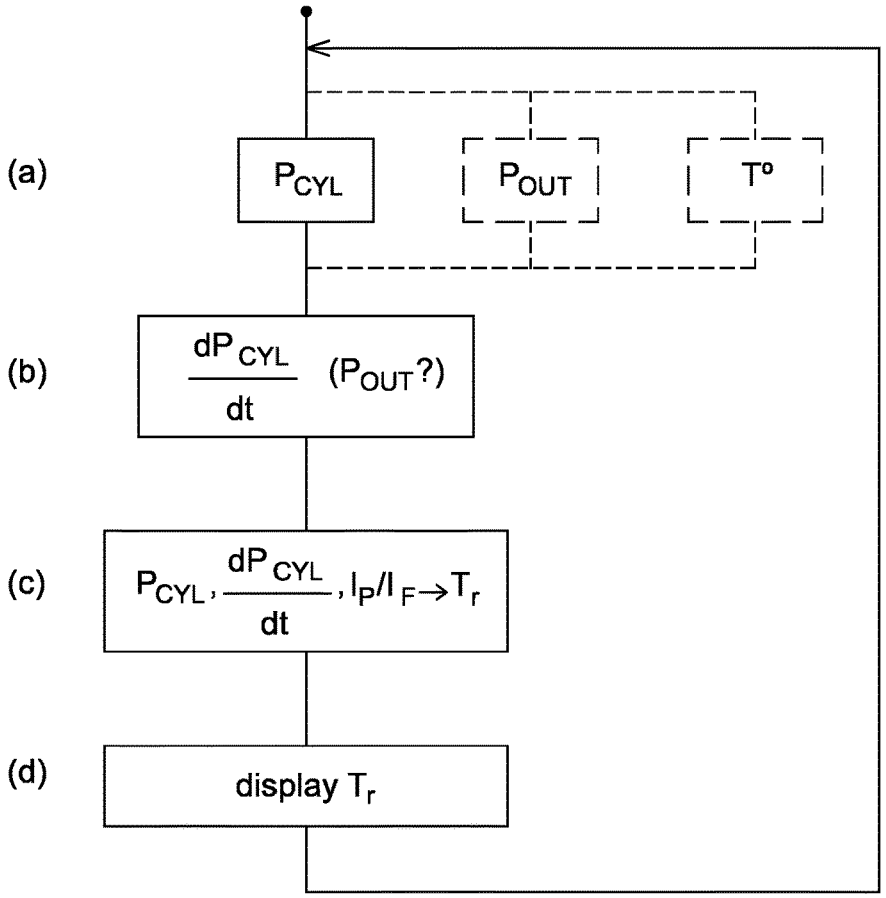
FIG. 5 is a flow chart illustrating the different steps of the algorithm that is executed by the electronic unit of the pressure reducer device of FIG. 1, in accordance with various embodiments of the invention.

FIGS. 2 to 4 illustrate the characteristics of a pressure reducer that are taken into account in the calculation algorithm illustrated in FIG. 5.

FIG. 2 is a schematic sectional view of a single stage pressure reducer that can correspond to the pressure reducer 14 of the device 6 of FIG. 1. In the single-stage pressure reducer 14 of FIG. 2, the closing member or poppet is on the inlet pressure side, as this will be described here after. The pressure reducer 14 comprises an inlet $\mathbf{14}^1$ that is in direct connection with the gas cylinder pressure. A movable closing member $\mathbf{14}^2$ cooperates with a seat $\mathbf{14}^3$ for restricting the gas passage so as to reduce its pressure in the reduced pressure chamber $\mathbf{14}^5$ delimited by the walls of the pressure reducer and the movable element $\mathbf{14}^4$ that supports the closing member $\mathbf{14}^2$. The reduced pressure chamber $\mathbf{14}^5$ is in direct connection with the outlet $\mathbf{14}^6$. First and second spring members $\mathbf{14}^7$ and $\mathbf{14}^8$ are provided at opposite end of the closing member assembly $\mathbf{14}^2/\mathbf{14}^4$. The principle of a pressure reducer as the one illustrated in FIG. 2 is to reduce the pressure in a regulated manner. When gas is flowing from the inlet $\mathbf{14}^1$ to the outlet $\mathbf{14}^6$, the restricted passage between the closing member $\mathbf{14}^2$ and the seat $\mathbf{14}^3$ accelerates the flow which is then decelerated in the chamber $\mathbf{14}^5$. In accordance with the Bernoulli's principle, the acceleration of the flow diminishes the static pressure of the gas. Most of the velocity of the flow that enters the chamber $\mathbf{14}^5$ is lost in vortices so that the static pressure remains reduced. The movable elements $\mathbf{14}^4$ delimits the chamber $\mathbf{14}^5$ in a gas tight manner so that if the reduced pressed in the chamber increases, that element $\mathbf{14}^4$ moves the closing member $\mathbf{14}^2$ closer to its seat so as to further restrict the passage and therefore reduce further the pressure. This regulation principle applies over the whole range of inlet pressure. When the closing member is located on the inlet side of the seat, the inlet pressure exerts some effort on the closing member so that when the inlet pressure progressively diminishes while consuming the gas stored in a container, the outlet pressure progressively increases. This phenomenon is due to the diminution of the effort exerted by the inlet pressure on closing member in the closing direction, and is illustrated in the curve 1 in FIG. 3.

FIG. 3 illustrates three characteristic curves 1, 2 and 3 of the variation of the outlet pressure of three types of pressure reducer over the inlet pressure. Curve 1 corresponds to a single-stage pressure reducer with the closing element on the inlet side, as illustrated in FIG. 2. Curve 2 corresponds to a double-stage pressure reducer where the pressure increase at the end of the inlet pressure decrease corresponds to the absence of regulation of the first high pressure stage. Curve 3 corresponds to a single-stage high flow rate pressure reducer.

In many applications, a single-stage pressure reducer with the closing element on the inlet side is used, in particular for delivering a flow at less than 20 litres per minute from a container with gas at the pressure at about 200 bar. The influence of the inlet pressure on the outlet pressure such pressure reducers can be reduced by increasing the ratio between the surface of the moving element delimiting the reduced pressure chamber and the cross-section of the seat. Increasing this ratio decreases however the flow rate so that inherently commercially commonly used pressure reducers provide a variation of the outlet pressure relative to the inlet pressure.

FIG. 4 illustrates with more details and in a normalized manner the outlet pressure $P_{out}$ of a single-stage pressure reducer with the closing element on the inlet side versus the inlet pressure $P_{cyl}$ at a nominal flow rate. As is visible the outlet pressure $P_{out}$ varies between $P_2$ and $P_5$ when the inlet pressure $P_{cyl}$ decreased down to $P_3$. $P_2$ is the nominal outlet pressure when the inlet pressure is equal to $P_3$ where $P_3=2.P_2+1$ bar. $P_5$ is the highest value of the outlet pressure. A pressure irregularity factor $I_p$ can be expressed as $(P_5-P_2)/P_2$. This factor can have values comprised between 5% and 30%. The variation of the flow rate relative to the inlet pressure is similar to the pressure curve of FIG. 4. Similarly, a flow rate irregularity factor $I_f$ can be expressed as the ration between the maximum variation of the flow rate for an inlet pressure ranging from the maximum to $P_3$ and the nominal flow rate at $P_3$. Similarly, this factor can have values comprised between 5% and 30%.

FIG. 5 is a flow chart illustrating the principle of the algorithm that is executed by the electronic unit of the device of FIG. 1 for calculating the remaining usage time $T_r$.

In step (a), the pressure in the cylinder $P_{cyl}$ is measured. Optionally, the outlet pressure $P_{out}$ and/or the temperature T° of the gas or the surroundings of the gas is measured.

In step (b), a variation of the pressure in the cylinder over time is calculated.

The time period over which this variation is measured can be of several seconds or even several minutes. This calculation is symbolized by the expression $dP_{cyl}/dt$ being understood that different ways are possible to implement this calculation, in particular in an iterative manner. When the variation is greater than a predetermined value, it can be deducted that a flow rate outputted. The presence of an output can be detected or confirmed by the detection of a pressure at the outlet $P_{out}$ greater than a predetermined level, e.g. 1 bar.

In step (c), the remaining time $T_r$ of use of the gas assembly at the current flow rate is calculated based on the cylinder pressure $P_{cyl}$, the variation of pressure in the cylinder $dP_{cyl}/dt$ and also the characteristics of the pressure reducer. Such characteristics can be the pressure irregularity factor $I_p$ and/or the flow rate irregularity factor $I_f$ of the pressure reducer. In the absence of irregularity, the remaining time $T_r$ can be easily computed by dividing the cylinder pressure $P_{cyl}$ by the pressure variation $dP_{cyl}/dt$. More specifically and in relation with the characteristic of the outlet pressure $P_{out}$ illustrated in FIG. 4, the remaining time $T_r$ until the pressure in the cylinder $P_{cyl}$ reaches a lower limit, e.g. $P_3$, can be calculated as follows $$T_r = \frac{P_{cyl} - P_3}{\frac{dP_{cyl}}{dt}}.$$

In view of the above described irregularity, the flow rate will not be constant during the consumption process of the gas in the cylinder. This implies that the pressure variation $dP_{cyl}/dt$ will also not be constant (for a predetermined fixed setting of the gas delivery conditions). In other words, if the outlet pressure $P_{out}$ varies over time, this will have an impact on the gas flow and therefore on the variation of pressure $P_{cyl}$ in the cylinder. In relation with FIG. 4, if the outlet pressure $P_{out}$ progressively increases while the cylinder is emptied, the flow rate progressively increases and the absolute value of the variation of pressure in the cylinder therefore also progressively increases instead of remaining constant (bearing in mind that the variation of pressure in the cylinder is a negative value). It is therefore necessary to take this into account. Many ways can be envisaged for integrating the above irregularity into the calculation of the remaining usage time. In view of the perfect gas law or the known models for real gas, it can be assumed that a known rate of variation in the outlet pressure or flow rate of the pressure reducer can be directly applied to the measured variation of pressure in the cylinder for corrective purposes. In other words, a variation of say 20% of the outlet pressure when emptying a cylinder from a full state will result in an increase of 20% of the variation of pressure in the cylinder. One way can consist in calculating an average pressure variation $(dP_{cyl}/dt)_{av}$ until reaching the minimum pressure $P_3$ in the cylinder, based on the measured pressure variation at a time t and the irregularity factor $I_p$, e.g.

$$\left(\frac{dP_{cyl}(t)}{dt}\right)_{av} = \frac{dP_{cyl}(t)}{dt} \cdot \left(1 + I_p \cdot \frac{P_{cyl}(t) - P_3}{P_{cyl}(t_0) - P_3} \cdot \frac{1}{2}\right)$$

where $P_{cyl}(t_0)$ is the cylinder pressure at the time $t_0$ when the cylinder is full.

In view of the iterative nature of the algorithm, it might be necessary to consider the correction to take based on where we are along the cylinder pressure axis in FIG. 4. If we are at the maximum cylinder pressure, e.g. 200 bar, at the very left of the x axis in FIG. 4, the average pressure variation will be approximately at the middle between the two horizontal limit line whereas if we are at the middle, e.g. 100 bar, the average pressure variation from that point until we reach $P_3$ will be different, i.e. higher.

Another way might be to calculate a quantity of gas in the cylinder based on the cylinder pressure and possibly the temperature (knowing the type of gas) and to calculate a current flow rate from the pressure variation $dP_{cyl}/dt$, e.g. by means of the ideal gas law or any known model for real gases. This flow rate can be corrected into an average flow rate from that point until the cylinder pressure reaches $P_3$. This can be done similarly to the above, i.e.

$$\dot{m}_{av}(t) = \dot{m}(t) \cdot \left(1 + I_f \cdot \frac{\dot{m}(t) - \dot{m}(P_3)}{\dot{m}(t_0) - \dot{m}(P_3)} \cdot \frac{1}{2}\right)$$

where $\dot{m}(t)$ is the flow rate at the time t, $\dot{m}(t_0)$ is the flow rate at the time $t_0$ when the cylinder is full, and $\dot{m}(P_3)$ is the flow rate when the cylinder pressure reaches the lower limit $P_3$.

The remaining time $T_r$ can be then obtained by dividing the calculated gas quantity by the average flow rate. Alternatively, a lookup table or a cartography of the flow rate of the pressure reducer along the cylinder pressure can be used for computing a more exact estimation, in particular if the irregularity is not linear.

In step (d), the computed remaining time $T_r$ can then be displayed to the user.

The pressure reducer device can comprise means for varying the flow rate and/or the outlet pressure (and implicitly the flow rate). Such means can be a flow selector. It can consist of a disk with calibrated holes that can be brought individually in gas tight alignment with a gas channel. In view of the fact that the flow rate can potentially be adjusted, it is advantageous that the above calculation is iterative, thereby taking into account any change in the functioning conditions of the gas assembly.

In the case of an increase of the flow rate, an increase in the variation of the cylinder pressure will be measure in step (a) and observed in step (b). In step (c), the remaining time $T_r$ will be recalculated or at least adjusted to take the new pressure variation into account, thereby providing a reliable autonomy indication. This is somehow similar to the autonomy indication in a vehicle that is computer on the measure level of fuel in the tank and the current fuel consumption. The indication of the distance that can still be travelled with the vehicle can increase while driving if the consumption decreases although the tank is not refilled.

The pressure reducer device of the present invention can be mounted in a cover that houses the different elements of the device.

The invention claimed is:

1. A method for calculating the remaining usage time of a gas cylinder equipped with a pressure reducer, said method comprising the following steps:

(a) measuring a pressure of the gas in the cylinder;

(b) calculating a variation of pressure of the gas in the cylinder over time while gas is outputted; and (c) calculating a remaining usage time $T_r$ based on the measured pressure in the cylinder and the calculated variation of pressure;

wherein step (c) takes into account characteristics of the pressure reducer relative to variations of its nominal flow rate along the decrease of its inlet pressure while emptying the cylinder in order to minimize an error in the calculated variation of pressure of the gas in the cylinder otherwise induced by said variations.

2. The method according to claim 1, wherein in step (c) the characteristics of the pressure reducer comprise a pressure irregularity factor $I_p$ reflecting the variation of the nominal outlet pressure of the pressure reducer along the decrease of its inlet pressure while emptying the cylinder.

3. The method according to claim 2, wherein the pressure irregularity factor $I_p$ is a ratio of a maximum outlet pressure difference by a nominal outlet pressure of the pressure reducer.

4. The method according to claim 2, wherein in step (c) an average variation of pressure of the gas in the cylinder is calculated based on the pressure irregularity factor $I_p$ and is used for calculating the remaining usage time $T_r$.

5. The method according to claim 1, wherein in step (c) the characteristics of the pressure reducer comprise a flow rate irregularity factor $I_f$ reflecting the variation of the nominal flow rate of the pressure reducer along the decrease of its inlet pressure while emptying the cylinder.

6. The method according to claim 5, wherein the flow rate irregularity factor $I_f$ is a ratio of a maximum flow rate difference by a nominal flow rate of the pressure reducer.

7. The method according to claim 5, wherein in step (c) an average flow rate until emptying the cylinder is calculated based on the calculated variation of pressure over time and the flow rate irregularity factor $I_f$ and is used for calculating the remaining usage time $T_r$.

8. The method according to claim 7, wherein in step (c) the calculation of the remaining usage time $T_r$ is based on the measured pressure in the cylinder and the average flow rate.

9. The method according to claim 1, wherein steps (a), (b) and (c) are executed in an iterative manner, and a lapse of time between each iteration comprises between 5 and 300 seconds.

10. The method according to claim 9, wherein, for each iteration, the calculation of step (b) is based on the variation of pressure over time calculated at the previous iteration.

11. The method according to claim 1, wherein step (b) is executed only when an output of gas is detected.

12. The method according to claim 11, wherein step (a) comprises measuring an outlet pressure $P_{out}$ of the pressure reducer, and wherein in step (b) the output of gas is detected when the measured outlet pressure $P_{out}$ is greater than a predetermined value.

13. The method according to claim 1, wherein the method comprises a step (d) of displaying the remaining usage time $T_r$.

14. An electronic unit for a pressure reducer device to be mounted on a gas cylinder, said electronic unit comprising:

a control unit;

a display; and at least one pressure sensor, wherein the control unit comprises a microcontroller with instructions for calculating a remaining usage time $T_r$ based on a measured pressure in the cylinder and a calculated variation of pressure;

wherein the instructions are configured for:

(a) measuring the pressure of the gas in the cylinder;

(b) calculating the variation of pressure of the gas in the cylinder over time while gas is outputted; and (c) calculating a remaining usage time $T_r$ based on the measured pressure in the cylinder and the calculated variation of pressure, wherein step (c) takes into account characteristics of the pressure reducer relative to variations of its nominal flow rate along the decrease of its inlet pressure while emptying the cylinder in order to minimize an error in the calculated variation of pressure of the gas in the cylinder otherwise induced by said variations.

15. The electronic unit according to claim 14, wherein the unit comprises an electric power source, the power source being external to at least one of the control unit and the display.

16. A pressure reducer device for a gas cylinder, said device comprising a body;

a pressure reducer in the body;

a flow selector in the body; and an electronic unit for calculating and displaying a remaining usage time $T_r$ while gas is outputted;

wherein the electronic unit comprises:

a control unit;

a display; and at least one pressure sensor;

wherein the control unit comprises a microcontroller with instructions for calculating a remaining usage time $T_r$ based on the measured pressure in the cylinder and the calculated variation of pressure, wherein the instructions are configured for:

(a) measuring the pressure of the gas in the cylinder;

(b) calculating the variation of pressure of the gas in the cylinder over time while gas is outputted;

(c) calculating a remaining usage time $T_r$ based on the measured pressure in the cylinder and the calculated variation of pressure, wherein step (c) takes into account characteristics of the pressure reducer relative to variations of its nominal flow rate along the decrease of its inlet pressure while emptying the cylinder in order to minimize an error in the calculated variation of pressure of the gas in the cylinder otherwise induced by said variations.

17. The pressure reducer device according to claim 16, further comprising a cover housing the body and the electronic unit.

* * * * *